US005167850A

United States Patent [19]

Shtarkman

[11] Patent Number: 5,167,850

[45] Date of Patent: * Dec. 1, 1992

[54] FLUID RESPONSIVE TO MAGNETIC FIELD

[75] Inventor: Emil M. Shtarkman, Southfield, Mich.

[73] Assignee: TRW Inc., Lyndhurst, Ohio

[ * ] Notice: The portion of the term of this patent subsequent to May 1, 2007 has been disclaimed.

[21] Appl. No.: 814,245

[22] Filed: Dec. 23, 1991

Related U.S. Application Data

[63] Continuation-in-part of Ser. No. 648,306, Jan. 28, 1991, abandoned, which is a continuation-in-part of Ser. No. 560,225, Jul. 19, 1990, abandoned, which is a continuation-in-part of Ser. No. 372,293, Jun. 27, 1989, abandoned.

[51] Int. Cl.[5] ..... H01F 1/28; H01F 1/32

[52] U.S. Cl. ..... 252/62.52; 252/78.3; 252/502; 252/503; 252/570

[58] Field of Search ..... 252/62.51, 62.52, 352, 252/309, 570, 572, 78.3, 502, 503, 513

[56] References Cited

U.S. PATENT DOCUMENTS

| | | | |
|---|---|---|---|
| 2,519,449 | 8/1950 | Findley | 192/84 |
| 2,661,596 | 12/1953 | Winslow | 60/52 |
| 2,663,809 | 12/1953 | Winslow | 310/78 |
| 2,772,761 | 12/1956 | Janson | 192/21.5 |
| 2,886,151 | 5/1959 | Winslow | 192/21.5 |
| 3,006,656 | 10/1961 | Schaub | 280/112 |
| 4,099,186 | 7/1978 | Edwards et al. | 356/74.7 |
| 4,105,572 | 8/1978 | Gorondy | 430/106 |
| 4,117,498 | 9/1978 | Edwards et al. | 346/74.7 |
| 4,191,961 | 3/1980 | Edwards et al. | 346/74.7 |
| 4,195,303 | 3/1980 | Edwards et al. | 346/74.7 |
| 4,323,904 | 4/1982 | Edwards et al. | 346/74.7 |
| 4,336,546 | 6/1982 | Edwards et al. | 346/74.7 |
| 4,338,391 | 7/1982 | Nacci et al. | 430/124 |
| 4,359,516 | 11/1982 | Nacci et al. | 252/62.54 |
| 4,604,229 | 8/1986 | Raj et al. | 252/62.52 |
| 4,626,370 | 12/1986 | Wakayama et al. | 252/62.52 |
| 4,737,886 | 4/1988 | Pedersen | 361/225 |
| 4,992,190 | 2/1991 | Shtarkman | 252/62.51 |

OTHER PUBLICATIONS

Brochure published by GAF Corporation of Wayne, N.J., containing the code IM-785, captioned "Carbonyl Iron Powders".

Publication entitled "Some Properties of Magnetic Fluids", J. D. Coolidge, Jr. and R. W. Halberg, AIEE Transactions, Paper 55-170 (Feb. 1955), pp. 149-152.

Publication entitled "The Magnetic Fluid Clutch" by Jacob Rabinow, NBS Tech. Rep. No. 1213 (1948) [also, Trans. Amer. Inst. Elec. Eng. Preprint 48-238 (1948)].

Publication entitled "The Magnetic Fluid Clutch" by S. F. Blunden, The Engineer, 191, 244 (1951).

Publication entitled "Further Development of the NBS Magnetic Fluid Clutch", NBS Tech. News Bull., 34, 168 (1950).

Publication entitled "Quest", Summer, 1986, pp. 53-63, by Jack L. Blumenthal, published by TRW Corporation.

*Primary Examiner*—Michael Lewis
*Assistant Examiner*—Stephen G. Kalinchak
*Attorney, Agent, or Firm*—Tarolli, Sundheim & Covell

[57] ABSTRACT

A rheological fluid composition which is responsive to a magnetic field. The composition comprises magnetizable insulated, reduced carbonyl iron particles, a vehicle and a dispersant. The dispersant comprises fibrous carbon particles.

16 Claims, 4 Drawing Sheets

FLUID RESPONSIVE TO MAGNETIC FIELD

This is a continuation-in-part of co-pending application Ser. No. 648,306 filed on Jan. 28, 1991 now abandoned which is a continuation-in-part of copending application Ser. No. 07/560,225 filed on Jul. 19, 1990 now abandoned which is a continuation in part of copending application Ser. No. 07/372,293 filed on Jun. 27, 1989, now abandoned.

BACKGROUND OF THE INVENTION

1. Technical Field

The present invention relates to a rheological fluid which is responsive to a magnetic field.

2. Background Art

Rheological fluids responsive to magnetic fields are known. Rheological fluids responsive to electric fields are also known. Such fluids are used in clutches, shock absorbers, and other devices. A characteristic of these rheological fluids is that, when they are exposed to the appropriate energy field, solid particles in the fluid move into alignment and the ability of the fluid to flow is substantially decreased.

Electric field responsive fluids and magnetic field responsive fluids include a vehicle, for instance a dielectric medium, such as mineral oil or silicone oil, and solid particles. In the case of a magnetic field responsive fluid, the solid particles are magnetizable. Examples, of solid particles which have been heretofore proposed for use in a magnetic field responsive fluid are magnetite and carbonyl iron. The fluid also may contain a surfactant to keep the solid particles in suspension in the vehicle.

A brochure published by GAF Corporation of Wayne, New Jersey, containing the code IM-785, captioned "Carbonyl Iron Powders", contains a discussion of carbonyl iron powders marketed by GAF Corporation. The iron particles are classified as "straight powders", "alloys", "reduced powders", and "insulated reduced powders". An example of a "straight powder" which is listed is a powder known as carbonyl "E".

A brief discussion is contained in the brochure concerning magnetic field responsive fluids. It is stated: "The spherically shaped particles of carbonyl iron presumably act like ball bearings in magnetic fluid coupling applications. The smallness of the iron particles gives larger surface area and more contacts than other powders and, hence, better transmission when locked. A lubricant and dispersant are generally required for best results." The discussion contains no disclosure concerning the type of carbonyl iron or dispersant to be employed in a magnetic field responsive fluid.

A publication entitled "Some Properties of Magnetic Fluids", J. D. Coolidge, Jr. and R. W. Halberg, AIEE Transactions, Paper 55-170 (Feb. 1955), pages 149-152, discloses the use of different carbonyl irons in a fluid responsive to a magnetic field. The carbonyl irons disclosed include carbonyl "E" and carbonyl "SF", so-called straight powders, and carbonyl "L", carbonyl "HP"-, and carbonyl "C", all reduced powders. The article contains no conclusions concerning the preference of one carbonyl iron over another in a magnetic field responsive fluid.

A publication entitled "The Magnetic Fluid Clutch" by Jacob Rabinow, NBS Tech. Rep. No. 1213 (1948) [also, Trans. Amer. Inst. Elec. Eng. Preprint 48-238 (1948)] discloses the use of hydrogen reduced iron and carbonyl iron "SF", a "straight" powder as indicated above.

A publication entitled "The Magnetic Fluid Clutch" by S. F. Blunden, The Engineer, 191, 244 (1951) discloses the use of two grades of carbonyl iron, grade "ME" and grade "MC". Grade "ME" is said to be mechanically "hard" and grade "MC" is said to be mechanically "soft". Here also, no preference is given for one carbonyl iron over another.

A publication entitled "Further Development of the NBS Magnetic Fluid Clutch", NBS Tech. News Bull., 34, 168 (1950) discloses the use of carbonyl "E" powder in a magnetic fluid. Other compositional information concerning the fluid is also given.

Prior U.S. Pat. No. 4,604,229 discloses the combination of a hydrocarbon carrier with 4%-10% magnetite, 8%-12% electrically conductive carbon black, and a dispersing agent. Powder magnetite ($Fe_3O_4$) is the fully oxidized magnetic oxide of iron, carbonyl iron, or iron-nickel. A similar disclosure is contained in U. S. Pat. No. 4,673,997.

U.S. Pat. No. 3,006,656 discloses a magnetic particle shock absorber using a composition which can contain carbonyl iron, a vehicle such as oil, and graphite. Carbonyl iron and magnetite are described as equivalant materials in the composition. It is not indicated in the patent which carbonyl iron was used.

U.S. Pat. No. 2,519,449 discloses the combination of carbonyl E and solid, powdered graphite in a 50/50 blend. The continuous phase or dielectric medium in the composition is air. The graphite functions as a lubricant.

U.S. Pat. No. 2,661,596 discloses a magnetically-responsive fluid which comprises 100 parts of iron carbonyl powder, 10 parts dielectric oil, and 2 parts dispersant, such as ferrous oleate. The form of carbonyl iron used is not disclosed. U.S. Pat. Nos. 2,663,809 and 2,886,151 disclose the use of carbonyl iron in a fluid coupling. The form of carbonyl iron used is not disclosed.

U.S. Pat. No. 2,772,761 discloses an electromagnetic clutch using a magnetically-responsive fluid comprising an iron powder which is an 80/20 blend of plast-iron and carbonyl "E", and a dispersant comprising 39% graphite, 46% naptha, and 15% alkyl resin, by way of example.

In U.S. Pat. No. 4,737,886, an electroviscous fluid is disclosed. The fluid is responsive to an electric field. Fluids responsive to magnetic fields are also discussed. It is stated in the patent that such magnetic fields require "relatively large electric currents and substantial electrical circuits (for example, large coil windings) to cause the proper response in the fluid".

A publication entitled "Quest, Summer, 1986, pages 53-63, by Jack L. Blumenthal, published by TRW Corporation, discloses the composition and properties of a carbonaceous material comprising fibrous carbon particles manufactured in a carbon disproportion reaction. The carbon fibers of the individual particles are intertwined forming a porous structure. The particles are capable of incorporating and suspending other finely divided powders in fluids.

SUMMARY OF THE INVENTION

It is an object of the present invention to provide an improved rheological magnetic field responsive fluid which has a high speed of responsiveness to a magnetic field and which magnetic field may be created by a relatively low current flow through a small number of coil windings.

The fluid composition of the present invention comprises a vehicle and solid magnetizable particles suspended in the vehicle. Preferably, the fluid composition also contains a dispersant. In accordance with the present invention, the magnetizable particles are insulated, reduced carbonyl iron particles.

The present invention also resides in the discovery of a novel dispersant for a magnetic field responsive fluid, which dispersant is fibrous carbon particles, each particle of which comprises intertwined carbon fibers having a length-to-diameter ratio in the range of about 10:1 to about 1,000:1. Preferably, the fibers have a surface area of about 300 square meters per gram.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
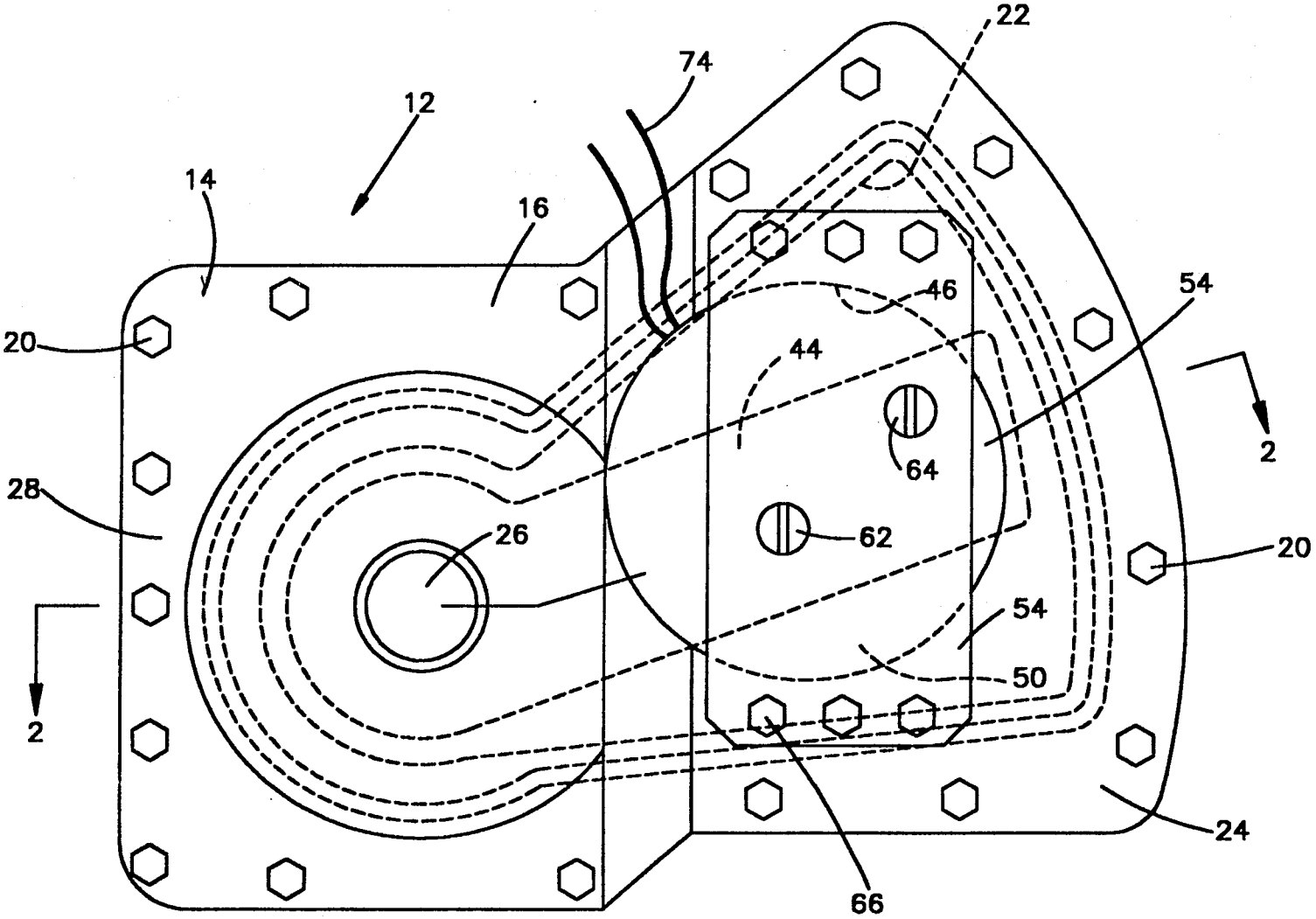
FIG. 1 is a view of an apparatus which uses a rheological fluid in accordance with the present invention.

The fluid composition of the present invention comprises a vehicle, such as mineral oil, silicone oil, or CONOCO LVT oil; an insulated reduced carbonyl iron; and preferably a dispersant of intertwined carbon fiber particles.

Carbonyl iron is manufactured by the decomposition of iron pentacarbonyl $Fe(CO)_5$. This process produces a spherical unreduced particle which has what is referred to as an onion-skin structure due to minute carbon deposits in alternating layers. The carbon content is about 1%. Reduction or de-carburization of the unreduced powder is carried out by exposing the powder to a hydrogen atmosphere, followed by compaction. This destroys the onion-skin structure and produces a composite of randomly arranged minute iron particles. The carbon content of the powder is about 0.075%.

In accordance with the present invention, the reduced powders have an insulation coating to prevent particle-to-particle contact. The particles are physically soft and compressible. Their shape is spherical. Reduced particles which are also insulated are marketed by GAF Corporation under the designations "GQ-4" and "GS-6". The following Table 1 gives physical and chemical properties for the insulated, reduced powders:

TABLE 1

| GAF Carbonyl Iron Powder Type | Avg. Particle Diameter Microns (Fisher Sub-Sieve Sizer) | Apparent Density g/cm$^3$ | Tap Density g/cm$^3$ | % Fe (Min) | % C (Max) | % O (Max) | % N (Max) |
|---|---|---|---|---|---|---|---|
| GQ-4 | 4–6 | 2.0–3.0 | 3.0–4.0 | 99.0 | 0.1 | 0.3 | 0.1 |
| GS-6 | 3–5 | 1.2–2.2 | 2.2–3.2 | 99.0 | 0.1 | 0.3 | 0.1 |

the data of Table 1 can be found on page 4 of the GAF brochure mentioned above, bearing the identifying code IM-785. The disclosure of the GAS brochure is incorporated herein by reference.

The insulation coating can be any particle-coating agent capable of insulating the carbonyl iron particles and preventing interparticle eddy currents or dielectric leakage. The insulation coating on the "GQ-4" and "GS-6" powders is a discontinuous layer of silicon oxide, primarily silicon dioxide. Silicon comprises, for example, about 6.9 atomic percent of the surface composition of the carbonyl iron particles. Silicon dioxide is dielectric, and provides electrical resistivity.

It is believed that the reduced powders have a more random arrangement of minute iron particles than the so-called "straight" powders, and that this results in a lower hysteresis effect than with the "straight" powders. The insulation on the powders is present in an effective amount to reduce parasitic eddy currents around the particles, which eddy currents could adversely affect the magnetic field strength in the fluid. The insulation thus enhances the efficiency of the magnetic fluids.

When the magnetic fluid composition of the present invention is used in certain coupling applications, such as in a clutch, the moving parts of the clutch stir the composition effectively and no dispersant is required. This is particularly the case where permanent magnets are used, and thus the clutch is never demagnetized. In such an instance, settling of the iron particles presents no problems.

In those applications where a dispersant is required, the composition of the present invention can employ any dispersant or surfactant conventionally employed with a fluid responsive to a magnetic field. Examples of surfactants employed in the prior art are: dispersants, such as ferrous oleate or ferrous naphthenate; aluminum soaps such as aluminum tristearate or aluminum distearate; alkaline soaps, such as lithium stearate or sodium stearate, employed to impart thixotropic properties; surfactants such as fatty acids, e.g., oleic acids; sulfonates, e.g., petroleum sulfonate; phosphate esters, e.g., alcohol esters of ethoxylated phosphate esters; and combinations of the above.

A preferred dispersant material is fibrous carbon. Fibrous carbon is a carbon particulate in which each carbon particle is composed of a large number of intertwined small carbon fibers. One such fibrous carbon is "TRW Carbon", trademark, TRW corporation. The "TRW Carbon" is disclosed in the publication "Quest", mentioned above. The disclosure of this publication is incorporated herein by reference.

The "TRW Carbon" is made in a catalytic carbon disproportion reaction in which a low heating value fuel gas or other source of carbon is used as the reaction feed. The individual fibers in the fibrous carbon are from 0.05 to 0.5 microns in diameter and up to several thousand times as long as they are thick. The preferred average length to diameter ratio is in the range of about 10:1 to about 1,000:1. Most of the fibers contain a single crystallite of a ferrous metal (such as iron, nickel, cobalt, or their alloys) or ferrous metal carbide. The carbon fibers grow during the disproportion reaction from opposite faces of the single crystallites. The crystallite usually represents 1 to 10 percent by weight of the material, but can be reduced to as low as 0.1 percent by acid leaching. Except for the crystallite, the fibers are almost pure carbon plus a small amount of hydrogen such as 0.5 to 1 percent. The fibers may be either hollow or porous.

Intertwining of the fibers into aggregated particles occurs during the disproportion reaction. The intertwining and formation of small interstices in the carbon particles allows the fibrous carbon to incorporate the micron-sized carbonyl iron particles and mechanically suspend the carbonyl iron particles dispersed in a fluid carrier. The fibrous carbon particles have a large surface area of about 300 square meters per gram and a low bulk density of about 0.02 to about 0.7 grams per milliliter. Pore volume of the fibrous carbon particles typically is about 0.5 to about 0.9 milliliters per gram.

The fibrous carbon particles have fluid-like characteristics and flow like a liquid similar to graphite. When placed in a liquid vehicle, in a dispersing amount, they thicken or gell the vehicle preventing settling of the carbonyl iron particles. They form a thixotropic mixture with the vehicle which has good flow properties when exposed to shear. The viscosity of the thixotropic mixture is relatively independent of temperature.

The vehicle of the composition of the present invention can be any vehicle conventionally employed in a fluid responsive to a magnetic field. Examples of suitable vehicles are set forth in the prior art referenced above. Preferably, the vehicle employed is an oil having a viscosity at about 100° F. between one and 1,000 centipoises. Specific examples of suitable vehicles and their viscosities are set forth in the following Table 2:

TABLE 2

| Vehicle | Viscosity |
|---|---|
| Conoco LVT oil | 1.5 centipoises at 100° F. |
| Kerosene | 1.9 centipoises at 81° F. |
| Light paraffin oil | 20 centipoises at 100° F. |
| Mineral oil (Kodak) | 40 centipoises at 100° F. |
| Silicone oil | 700 centipoises at 100° F. |

The proportions of ingredients employed in the composition of the present invention can vary over wide ranges. In those compositions requiring the use of a dispersant, the dispersant is employed in an amount effective to disperse the carbonyl iron particles and to maintain such particles in suspension in the vehicle. The amount of vehicle used is that amounts necessary for the vehicle to function as the continuous phase of the composition. Air pockets in the composition should be avoided. The remainder of the composition is essentially the carbonyl iron powder. Preferably, the carbonyl iron to dispersant weight ratio is about 90:10 to about 99.5:0.5. The weight of the vehicle is about 15% to about 50% of the combined weight of the carbonyl iron and dispersant.

Particular ratios selected depend upon the application for the composition of the present invention. Preferably, the proportions are such that the composition of the present invention has thixotropic properties and is mechanically stable in the sense that the compositions remain homogeneous for prolonged periods of time.

In those compositions consisting essentially of insulated, reduced carbonyl iron and vehicle, the vehicle is employed in an amount effective so that it is the continuous phase in the composition. The specific amount used is dependent upon the properties of the vehicle, such as viscosity. A preferred weight ratio of vehicle to carbonyl iron is in the range of about 15%–55% vehicle to about 85%–45% carbonyl iron.

EXAMPLE 1

In this Example, 99% by weight carbonyl iron and 1% by weight TRW carbon were mixed together. A mixture of 20% by weight of Conoco LVT oil and 80% by weight of the carbonyl iron and TRW carbon mixture was then homogenized in a homogenizer for 12–24 hours under vacuum. Intensive mixing in the homogenizer functioned to thoroughly mix the TRW carbon and carbonyl iron with entrapment of the carbonyl iron in the fibrous structure of the TRW carbon. It also effected thorough wetting of all surfaces of the TRW carbon and carbonyl iron with LVT oil. The particular carbonyl iron employed was carbonyl "GS-6", trademark GAF Corporation.

A test apparatus was constructed to determine the coupling load characteristics of the composition under various conditions. The test apparatus is similar in construction to the shock absorber disclosed in co-pending application Ser. No. 339,126, filed Apr. 14, 1989, assigned to the assignee of the present application. The test apparatus is illustrated in the drawings of this application.

Figure 2:
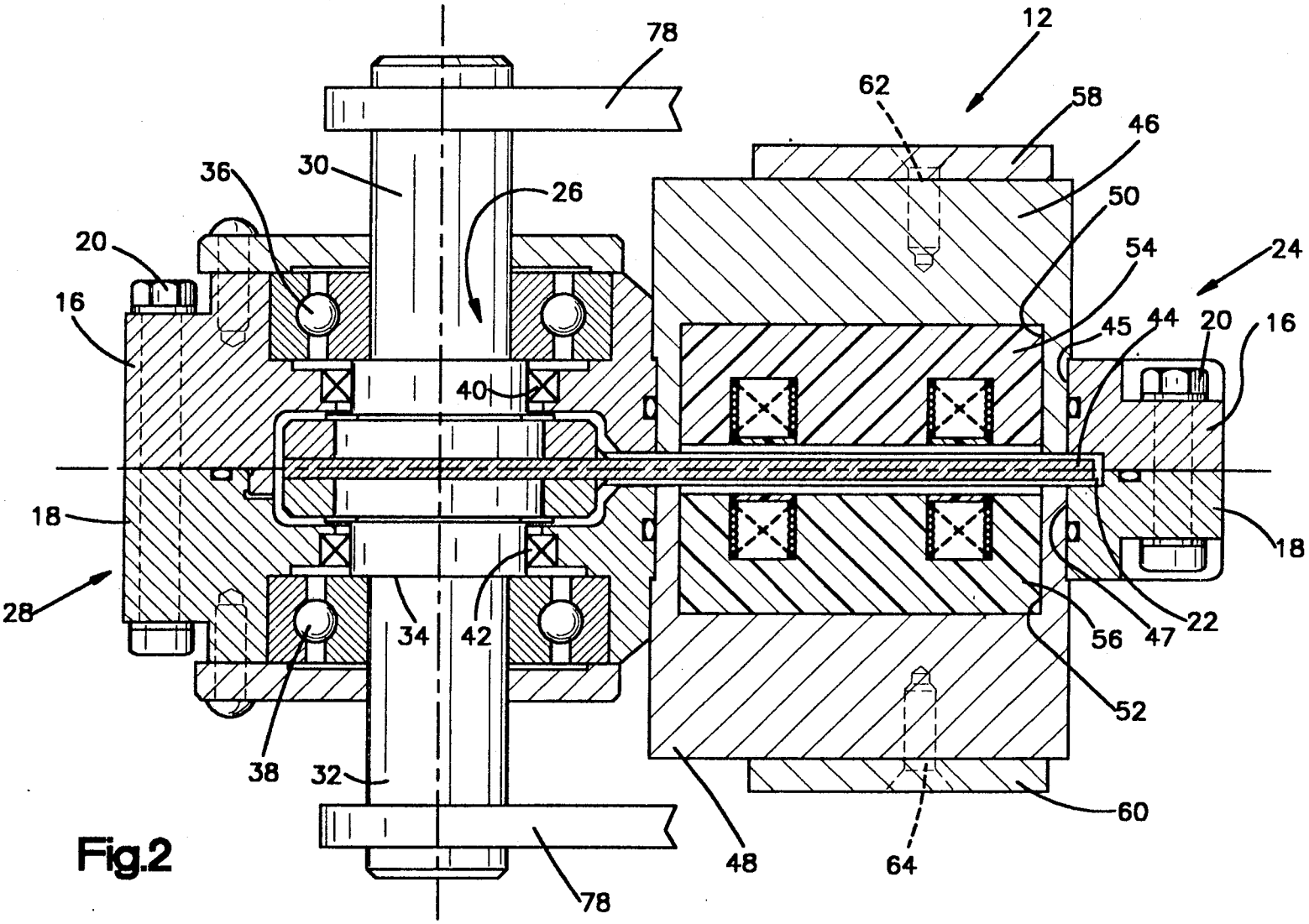
FIG. 2 is a sectional view taken along line 2—2 of FIG. 1.

Referring specifically to FIGS. 1 and 2, the test apparatus 12 comprises a non-magnetic aluminum housing 14. The housing 14 comprises first and second housing sections 16 and 18 (FIG. 2) which are fastened together by bolts 20. The housing sections 16, 18 define a fluid chamber 22 (FIG. 2) in the right end portion 24, as viewed in the drawings, of the housing. A shaft 26 extends through the left end portion 28, as viewed in the drawings, of the housing 14. The shaft 26 has shaft end sections 30 and 32 (FIG. 2) and a shaft center section 34. The shaft 26 rotates in bearing assemblies 36 and 38. Seals 40, 42 prevent fluid leakage along the shaft 26.

Figure 3:
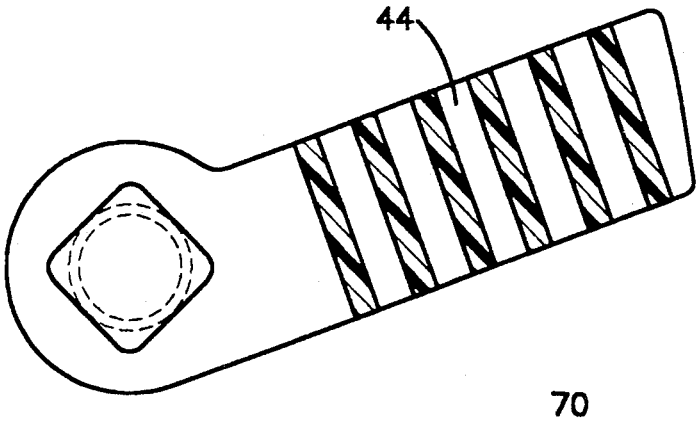
FIG. 3 is a plan view of a blade used in the apparatus of FIG. 1.

The center section 34 of the shaft 26 has a square configuration. A rotor blade 44 is fixed to the center section 34 so as to rotate with the shaft. The rotor blade 44 has a configuration as shown in FIG. 3. It extends radially from the shaft center section 34 into the fluid chamber 22.

The right-end portion 24 of the housing 14 has an opening 45 in which holder 46 for an electromagnet 54 is located and an opening 47 in which a holder 48 is located for an electromagnet 56. The holders 46, 48 have chambers 50, 52, respectively, in which the electromagnets 54, 56 are located.

The holders 46, 48 are secured to the housing sections 16 and 18 by means of brackets 58, 60, respectively. Screws 62, 64 hold the coil holders 46, 48 to the brackets 58, 60, respectively. Screws 66 (FIG. 1) hold the brackets 58, 60 to the housing sections 16, 18. The electromagnets 54, 56 can be chemically bonded to the holders 46, 48 or alternatively fastened to the holders by screws not shown. The non-magnetic material of the housing 12 and holders 46, 48 minimizes leakage of magnetic flux from the electromagnets 54, 56.

Figure 4:
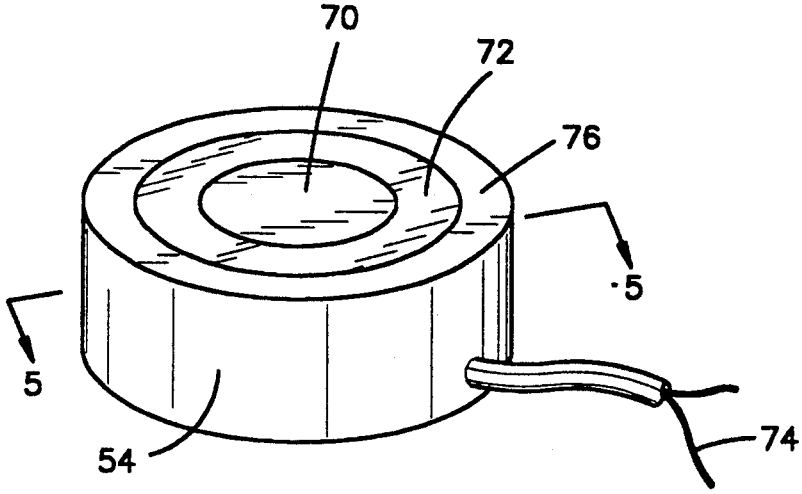
FIG. 4 is a perspective view of an electromagnet used in the apparatus of FIG. 1.
Figure 5:
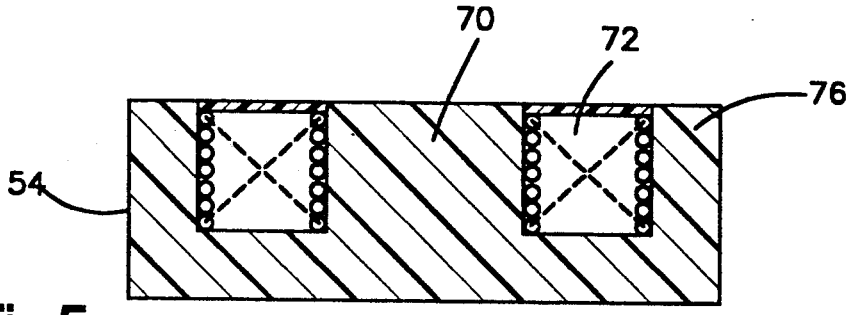
FIG. 5 is an enlarged sectional view taken along line 5—5 of FIG. 4.
Figure 6:
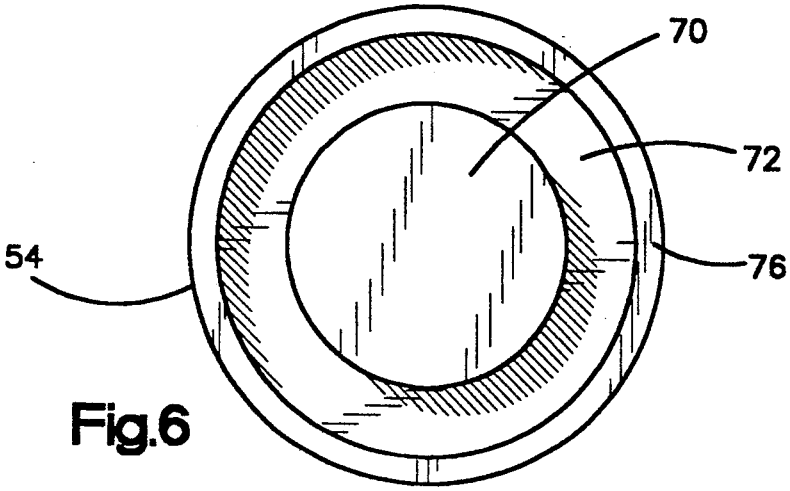
FIG. 6 is a plan view of the electromagnet of FIG. 4.

FIGS. 4, 5 and 6 show details of the electromagnets 54, 56. Each electromagnet 54, 56 comprises a soft iron core 70 around which an electrical coil 72 is wound. The electrical coil 72 is covered with an encapsulating material such as an epoxy. Each of the electromagnets 54, 56 has a pair of wire ends 74. An outer soft iron pole 76 extends around the coil 72.

The electromagnets 54, 56 are mounted so that the poles of the electromagnets 54 face the poles of the electromagnet 56. The rotor blade 44, and the fluid chamber 22, are positioned between the electromagnets 54, 56. The spacing between one electromagnet and the blade is about 0.25 millimeters. The blade thickness is about two millimeters. In the present Example, the center core 70 of each electromagnet has a diameter of 1.50 inches. The outside diameter of each electromagnet is three inches. The outer pole 76 has a radial thickness of 0.1875 inches. Each electromagnet coil 72 has 894 wire turns.

When the coils 54, 56 are energized, each electromagnet generates its own magnetic field. Lines of magnetic flux are established between the two electromagnets. The lines of magnetic flux pass through the fluid in the fluid chamber 22 and through the rotor blade 44. These lines of magnetic flux act on the fluid in the fluid chamber 22 to vary the resistance to movement of the rotor blade 44 in the fluid.

To test the coupling strength of the magnetic fluid of the present invention, when exposed to a magnetic field, the shaft 26 was connected by means of arms 78 (FIG. 2) to a torque motor (not shown). The torque motor was associated with a means for measuring torque. Different currents were applied to the electromagnets 54, 56. The torque required to turn the blade in the magnetic fluid in chamber 22, under the influence of the magnetic field, was measured. The results of the test are shown in FIG. 7.

Figure 7:
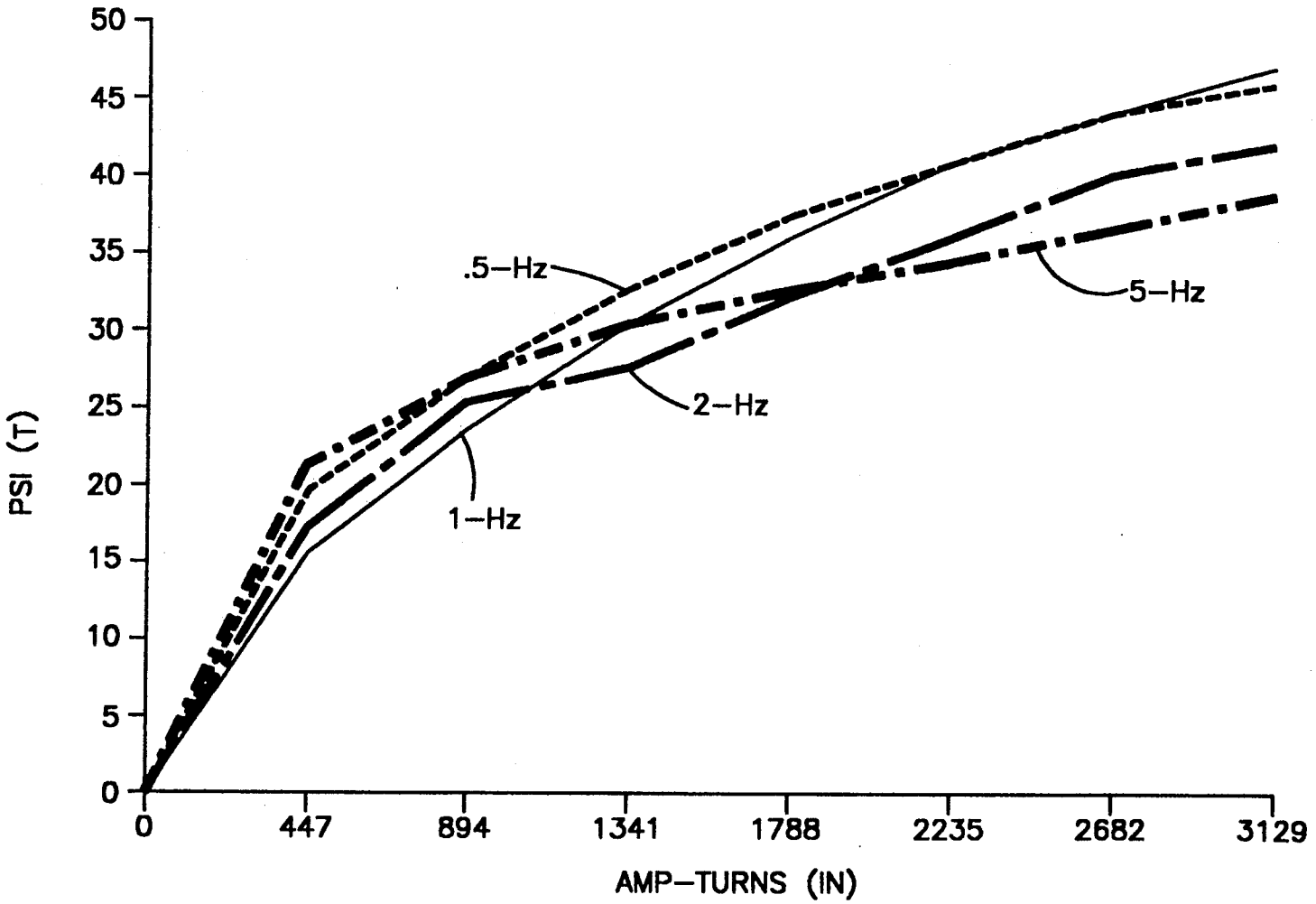
FIG. 7 is a graph illustrating operational characteristics of the apparatus of FIG. 1.

Referring to FIG. 7, the current flow in amp-turns is plotted along the X axis. The current employed varied from zero to about three and one-half amps (3129 amp turns). The resistance to turning of the blade 44 in terms of pounds per square inch is given along the Y axis and varied from about zero to about 50 psi. This measurement was obtained by dividing the pounds of torque required to turn the blade by the blade surface area exposed to the magnetic responsive fluid in chamber 22. Also measurements were taken at different frequencies of oscillation varying from 0.5 Hertz to 5 Hertz.

As shown, the resistance to turning at zero current was nearly zero indicating excellent lubricating properties of the composition of the present invention. The resistance to turning increased rapidly with increase in current flow up to about 38–48 pounds per square inch at 3129 amp-turns (about 3 ½ amps). The measurements were taken at different frequencies and all measurements followed quite similar curves indicating that the composition of the present invention is relatively frequency insensitive.

In contrast, a conventional magnetic field responsive fluid would require currents of substantially greater magnitude to achieve equivalent coupling strength. That is, a conventional magnetic field responsive rheological fluid might provide a coupling strength of less than one pound per square inch with a magnetic field generated with a current flow of about 3129 amp-turns. Thus, the rheological fluid of the present invention permits the construction of very compact, magnetic field responsive fluid devices having a relatively high coupling strength.

EXAMPLE 2.

Comparative tests were conducted comparing a rheological fluid containing the insulated reduced carbonyl iron of the present invention with fluids containing magnetizable powders other than insulated reduced carbonyl iron. The following Table 3 lists the powders which were compared:

TABLE 3

| Powder | New Grade Designation | Former Grade Designation |
|---|---|---|
| Carbonyl Iron, Carbonyl "E" | CIP-S-1651 | "E" |
| Reduced Carbonyl Iron Powder | CIP-R-1440 | "C" |
| Insulated Reduced Carbonyl Iron Powder | CIP-R-2511 | "GS-6" |
| Magnetite | — | — |

The three carbonyl iron powders were obtained from GAF Chemicals Corporation. Table 3 gives new GAF grade designations and former GAF grade designations for the powders. Magnetite is an iron oxide powder available commercially from a number of sources.

Compositions were prepared using each of the powders. The compositions were the same as the composition of Example 1, except for the iron powders used. The compositions were processed in he same way as disclosed in Example 1, and then were tested in an apparatus the same as disclosed in Example 1. The apparatus had a fluid gap of 0.5 millimeters. The coils 54, 56 (FIG. 2) were energized with a direct current to 7.666 amps. Measurements were taken at four frequencies of oscillation of the rotor blade 44, one hertz, three hertz, four hertz, and five hertz. At each frequency, three measurements were taken with each powder. The time constant, the torque ratio, and the total time to reach the maximum current of 7.666 amps were measured. The time constant gives the elapsed time until the current through the apparatus coils reaches 63.2% of the maximum current of 7.666 amps. The torque ratio is the ratio of the torque at that elapsed time to full torque at 7.666 amps. The total time is the elapsed time until the maximum current of 7.666 amps is reached.

The torque ratio is particularly useful measurement because it is relatively independent of other factors involved, for instance, the specific test apparatus which is used, the specific oil vehicle, the proportions of ingredients, coil turns, maximum current, and fluid gap. Any torque measuring apparatus capable of exposing the composition to a magnetic field and measurement the coupling strength exerted by the fluid on two relatively movable components, equivalent in these respects to the apparatus of the FIGS., can be used. The same results, subject to normal deviation, will be obtained. Similarly, any composition, within the scope of the claims herein, will give the same results, subject to normal deviation. Any direct or alternating current useful in the apparatus can be employed.

The following Table 4 summarizes the results which were obtained:

TABLE 4

| Frequency Hertz | Measurement | Carbonyl "E" GAF Grade CIP-S-1651 (Formerly "E") | Reduced Carbonyl Iron GAF Grade CIP-R-1440 (Formerly "C") | Magnetite ($Fe_3O_4$) | Insulated Reduced Carbonyl Iron GAF Grade CIP-R-2511 (Formerly "GS-6") |
|---|---|---|---|---|---|
| 1 | Time Constant | 93 millisec. | 78.5 millisec. | — | 73 millisec. |
| | Torque Ratio | 0.50 | 0.370 | — | 0.84 |
| | Total Time/Full Torque | — | 370 millisec. | 6 sec. | — |
| 3 | Time Constant | 94 millisec. | 79 millisec. | 90 millisec. | 75 millisec. |
| | Torque Ratio | 0.60 | 0.667 | — | 0.93 |
| | Total Time/Full Torque | 160 millisec. | 120 millisec. | 3 sec. | 72 millisec. |
| 4 | Time Constant | 92 millisec. | 81 millisec. | 85 millisec. | 76 millisec. |
| | Torque Ratio | 0.652 | 0.665 | — | 0.865 |
| | Total Time/Full Torque | — | 124 millisec. | — | 76 millisec. |
| 5 | Time Constant | 91 millisec. | 79 millisec. | 90 millisec. | 75 millisec. |
| | Torque Ratio | 0.71 | 0.640 | — | 0.921 |
| | Total Time/Full Torque | 128 millisec. | 122 millisec. | 2.3 sec. | 63 millisec. |

The advantages of the rheological fluid of the present invention are illustrated in Table 4, in the property "Torque Ratio". A high torque ratio indicates a fast response time. The rheological fluids of the present invention are particularly useful for applications such as shock absorbers. Shock absorbers are subjected to rapid shocks requiring rapid dampening, in turn requiring fast response times.

The data of Table 4 shows that the torque ratio, for insulated reduced carbonyl iron, was about 0.8 or higher at all frequencies. In contrast, magnetite gave no measurable torque at two-thirds full current. The torque ratios for carbonyl "E" were relatively small, less than 0.7, at all frequencies. Similarly, the torque ratios for reduced carbonyl iron were relatively small, less than 0.67, at all frequencies.

The results noted for torque ratio are confirmed in the data for total elapsed time to reach the maximum current of 7.666 amps. A short total elapsed time is also indicative of a fast response. The rheological fluid of the present invention gave a total elapsed time in the range of about 63–76 milliseconds, at 3, 4, and 5 hertz. In contrast, the total elapsed time for carbonyl "E" ranged from 128 to 160 milliseconds; for reduced carbonyl iron, from 120 to 370 milliseconds; and for magnetite, 2.3–6 seconds.

Based on the data of Table 4 and other observations, it was determined that, for satisfactory results in an apparatus requiring a fast response time, a rheological fluid should provide a torque ratio of at least 0.7, preferably at least 0.75.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, I claim:

1. A fluid composition which is responsive to a magnetic field, said fluid composition comprising an oil vehicle, and a solid magnetizable particulate suspended in said vehicle, said magnetizable particulate being an electrically insulated reduced carbonyl iron present in said composition in an amount effective to provide said composition with magnetic properties.

2. The fluid composition of claim 1 wherein said carbonyl iron has a particle size in the range of 3 to 6 microns.

3. The fluid composition of claim 1 wherein the oil vehicle is 15 to 55 weight percent of the mixture of oil vehicle and carbon iron and the carbonyl iron and the carbonyl iron is 85 to 45 weight percent of the mixture of oil vehicle and carbonyl iron.

4. The fluid composition of claim 1 wherein the insulation on said carbonyl iron is a layer of silicon oxide and the carbon content of said iron is less than 0.1%.

5. A fluid composition which is responsive to a magnetic field, said fluid composition comprising an oil vehicle, and a solid magnetizable particulate suspended in said vehicle, said magnetizable particulate being an electrically insulated reduced carbonyl iron present in said composition in an amount effective to provide said composition with magnetic properties wherein said composition when (i) placed in a torque measuring device which includes a member pivotal in the composition, a mechanism for pivoting the member, and a torque sensing means for sensing the torque pivoting the member, and (ii) exposed to a magnetic field induced by an electric current provides a dynamic torque ratio of at least 0.7, the dynamic torque ratio being the ratio of the torque measured by the torque sensing means at about two-thirds maximum current with the member pivoting to the torque reached at maximum current with the member pivoting as the current increases from zero to maximum in said torque measuring device.

6. The fluid composition of claim 5 wherein said composition comprises a dispersant for dispersing the magnetizable particulate throughout the oil vehicle, the oil vehicle being the continuous phase of the composition.

7. The fluid composition of claim 6 wherein said dispersant comprises fibrous carbon particles, the fibers of which have a length-to-diameter ratio in the range of about 10:1 to about 1,000:1.

8. The fluid composition of claim 7 wherein said oil vehicle has a viscosity in the range of about one to 1,000 centipoises at 100° F.

9. The fluid composition of claim 8 wherein said composition comprises:

said electrically insulated reduced carbonyl iron and sid dispersant in the ratio of about 0.5 to 10 weight parts of said dispersant to about 90 to 99.5 weight parts of said carbonyl iron; and said oil vehicle comprises about 15 to 50 weight percent of the combined weight of the carbonyl iron and the dispersant.

10. The fluid composition of claim 5 wherein said insulated, reduced carbonyl iron comprises reduced carbonyl iron insulated with a silicon oxide.

11. The fluid composition of claim 5 providing a torque ratio of at least 0.75.

12. A fluid composition which is responsive to a magnetic field, said fluid composition comprising an oil vehicle, a solid magnetizable particulate suspended in said vehicle, and a dispersant, said dispersant comprising fibrous carbon particles the fibers of which have a length-to-diameter ratio in the range of about 10:1 to about 1,000:1 and a surface area of about 300 square meters per gram, said magnetizable particulate being an electrically insulated reduced carbonyl iron present in said composition in an amount effective to provide said composition with magnetic properties, wherein said composition when (i) placed in a torque measuring device which includes a member pivotal in the composition, a mechanism for pivoting the member, and a torque sensing means for sensing the torque pivoting the member, and (ii) exposed to a magnetic field induced by an electric current provides a dynamic torque ratio of at least 0.7, the dynamic torque ratio being the ratio of the torque measured by the torque sensing means at about two-thirds maximum current with the member pivoting to the torque reached at maximum current with the member pivoting as the current increases from zero to maximum in said torque measuring device.

13. The fluid composition of claim 12 wherein said insulated, reduced carbonyl iron comprises reduced carbonyl iron insulated with a silicon oxide.

14. The fluid composition of claim 12 providing a torque ratio of at least 0.75.

15. A fluid composition which is responsive to a magnetic field, said fluid composition comprising an oil vehicle, and a solid magnetizable particulate suspended in said vehicle, said magnetizable particulate being an electrically insulated reduced carbonyl iron present in said composition in an amount effective to provide said composition with magnetic properties, the oil vehicle being 15 to 55 weight percent of the mixture of oil vehicle and carbonyl iron and the carbonyl iron being 85 to 45 weight percent of the mixture of oil vehicle and carbonyl iron, wherein said composition when (i) placed in a torque measuring device which includes a member pivotal in the composition, a mechanism for pivoting the member, and a torque sensing means for sensing the torque pivoting the member, and (ii) exposed to a magnetic field induced by an electric current provides a dynamic torque ratio of at least 0.7, the dynamic torque ratio being he ratio of the torque measured by the torque sensing means at about two-thirds maximum current with the member pivoting to the torque reached at maximum current with the member pivoting as the current increases from zero to maximum in said torque measuring device.

16. A fluid composition which is responsive to a magnetic field, said fluid composition comprising an oil vehicle, a solid magnetizable particulate suspended in said vehicle, and a dispersant, said dispersant comprising fibrous carbon particles the fibers of which have a length-to-diameter ratio in the range of about 10:1 to about 1,000:1 and a surface are of about 300 square meters per gram, said magnetizable particulate being an electrically insulated reduced carbonyl iron present in said composition in an amount effective to provide said composition with magnetic properties, said composition comprising said carbonyl iron and dispersant in the ratio of about 90 to 99.5 weight parts of said carbonyl iron to about 10 to 0.5 weight parts of said dispersant, and said oil vehicle in the proportion of about 15 to 50 weight percent based on the combined weight of the carbonyl iron and the dispersant, wherein said composition when (i) placed in a torque measuring device which includes a member pivotal in the composition, a mechanism for pivoting the member, and a torque sensing means for sensing the torque pivoting the member, and (ii) exposed to a magnetic field induced by an electric current provides a dynamic torque ratio of at least 0.7, the dynamic torque ratio being the ratio of the torque measured by the torque sensing means at about two-thirds maximum current with the member pivoting to the torque reached at maximum current with the member pivoting as the current increases from zero to maximum in said torque measuring device.

* * * * *

UNITED STATES PATENT AND TRADEMARK OFFICE

CERTIFICATE OF CORRECTION

PATENT NO. : 5,167,850

DATED : December 1, 1992

INVENTOR(S) : Emil M. Shtarkman

It is certified that error appears in the above-identified patent and that said Letters Patent is hereby corrected as shown below:

Column 9, Line 68, Claim 3, Change "carbon" to --carbonyl--.

Column 9, Line 68, Claim 3, After "iron" delete "and the carbonyl iron".

Column 10, Line 58, Claim 9, Change "sid" to --said--.

Column 12, Line 5, Claim 15, Change "he" to --the--.

Column 12, Line 17, Claim 16, Change "are" to --area--.

Signed and Sealed this

Seventh Day of December, 1993

*Attest:*

Bruce Lehman

BRUCE LEHMAN

*Attesting Officer*

*Commissioner of Patents and Trademarks*